US005158476A

United States Patent [19]

Kirby

[11] Patent Number: 5,158,476

[45] Date of Patent: Oct. 27, 1992

[54] MODULAR STRAIN RELIEF DEVICE FOR ELECTRICAL CONNECTORS

[75] Inventor: Lane C. Kirby, West Point, Ind.

[73] Assignee: Landis & Gyr Metering Inc., Lafayette, Ind.

[21] Appl. No.: 826,920

[22] Filed: Jan. 24, 1992

[51] Int. Cl.[5] ..... H01R 13/58

[52] U.S. Cl. ..... 439/471; 439/458

[58] Field of Search ..... 439/449, 452, 456–460, 439/464, 470, 471

[56] References Cited

U.S. PATENT DOCUMENTS

| | | | |
|---|---|---|---|
| 3,794,959 | 2/1974 | Kamolz | 439/471 |
| 3,997,234 | 12/1976 | Worman | 439/456 |
| 4,341,431 | 7/1982 | Woratyla | 439/471 |
| 4,488,769 | 12/1984 | Feigl | 439/449 |
| 4,538,873 | 9/1985 | Worth . | |
| 4,538,875 | 9/1985 | Krenz . | |
| 4,652,072 | 3/1987 | Arasi, Jr. . | |
| 4,802,864 | 2/1989 | Michaels et al. . | |
| 4,822,286 | 4/1989 | Bianca . | |
| 4,840,581 | 6/1989 | Leufert et al. . | |
| 4,886,942 | 12/1989 | Lenz et al. . | |

FOREIGN PATENT DOCUMENTS 0023534 of 1915 United Kingdom ..... 439/458

*Primary Examiner*—Eugene F. Desmond

*Attorney, Agent, or Firm*—Woodard, Emhardt, Naughton, Moriarty & McNett

[57] ABSTRACT

A modular strain relief device is plugged directly into an electrical connector location in the interior of a housing assembly, according to one embodiment of this invention. The body of the strain relief connector provides a surface around which a portion of the wire conductor is wrapped for additional strain relief. Arm-like projections keep the wire conductors in close proximity to the body of the strain relief connector. An integrally molded locking structure attached to one end of the body of the strain relief connector allows it to be locked into an unused plug-in connector location inside the housing assembly. A bundle of wire conductors is secured to the flexible body of the strain relief connector with a cable tie placed through an aperture in a molded projection located at one end of the body of the strain relief device.

15 Claims, 5 Drawing Sheets

MODULAR STRAIN RELIEF DEVICE FOR ELECTRICAL CONNECTORS

BACKGROUND OF THE INVENTION

The device relates generally to the field of strain relief devices for use with electrical connectors and more particularly to a removable plug-in strain relief device for use in a housing assembly having multiple plug-in connector locations.

It has been realized in the art of electrical connectors that it is useful to provide strain relief protection to preserve the electrical connection between a wire conductor and an electrical connector. Strain relief devices are designed to reduce excessive force, such as a pulling force, applied to a cable made up of a number of wire conductors in order to preserve the electrical contact.

Prior devices are typically of two main types. The first type of device provides for a strain relief component integrally molded to the connector housing, as in U.S. Pat. No. 4,822,286 to Bianca. The second type of strain relief device is external to the connector housing. The latter appears in two categories: a protective yoke formed around the cable entering the connector assembly, see U.S. Pat. No. 4,840,581 to Leufert; or a strain relief device and a connector assembly both specially designed to couple together using a pair of molded projections on the sides of the housing assembly to mate with recesses on the strain relief, see U.S. Pat. No. 4,538,873 to Worth.

There is a need for a strain relief device that is modular for use without the need for a specially designed or molded housing assembly. There is a further need for a strain relief device that locks into a housing assembly designed for the use of multiple plug-in connectors without undergoing any additional molding or design.

SUMMARY OF THE INVENTION

Briefly describing one aspect of the present invention, a modular plug-in device is provided which is useful for preserving the electrical contact between a wire conductor and an electrical plug-in connector in a housing assembly having multiple plug-in connector locations. In one embodiment a strain relief device, as described herein, emulates the physical characteristics of a plug-in connector, enabling its insertion into pre-existing housing assemblies without the need for special tools or fasteners and having no multiple pieces.

The device comprises a flexible, strain absorbing body used to support a portion of a wire conductor wrapped transversely across the body, arms for maintaining the wire conductor in close proximity to the body, and locking means for locking the device into the interior of a housing assembly. Wrapping the wires transversely across the body allows the body of the device to absorb any external forces exerted on the wire conductors rather than allowing the force to strain the conductor to connector interface.

Another aspect of the present invention is that the modular strain relief device locks into an unused cavity, preferably a plug-in connector location, inside the housing assembly. One advantage of this feature is that it is no longer necessary to mold special housing assemblies in order to provide strain relief for the electrical connectors. Nor is it necessary to mold or assemble multiple parts or to use special tools to construct the strain relief device in order to obtain the desired strain relief.

A further aspect of the present invention is to provide a modular plug-in strain relief connector having a molded projection containing an aperture useful for securing a cable of wire conductors to the body of the strain relief connector for the purpose of providing additional strain relief. The flexibility of the body provides ample protection from forces exerted by pulling up or down on the cable of wire conductors.

Further objects and advantages of the present invention may be discerned by persons of ordinary skill in the art after reviewing the following written description and accompanying figures.

DESCRIPTION OF THE PREFERRED EMBODIMENT

Figure 1:
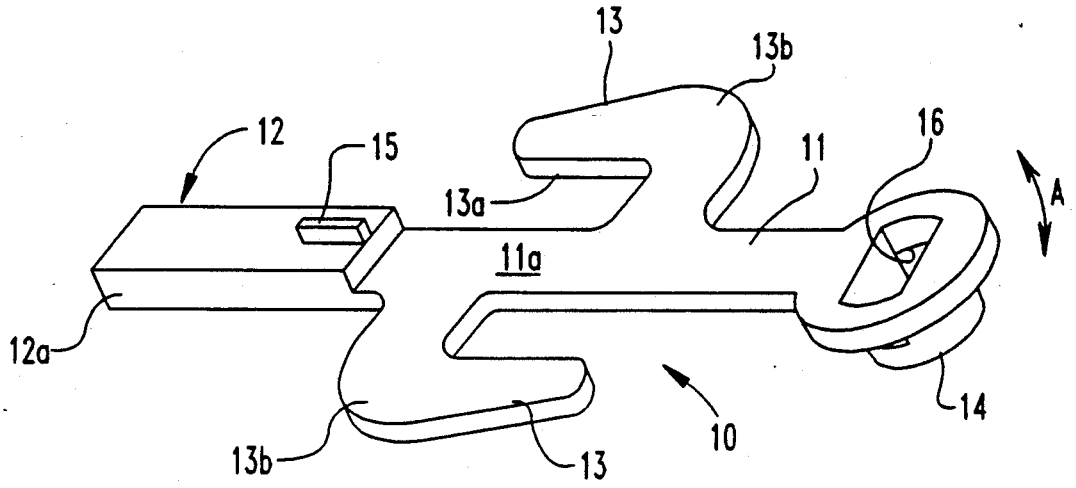
FIG. 1 is a top perspective view of a modular plug-in strain relief connector in accordance with one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
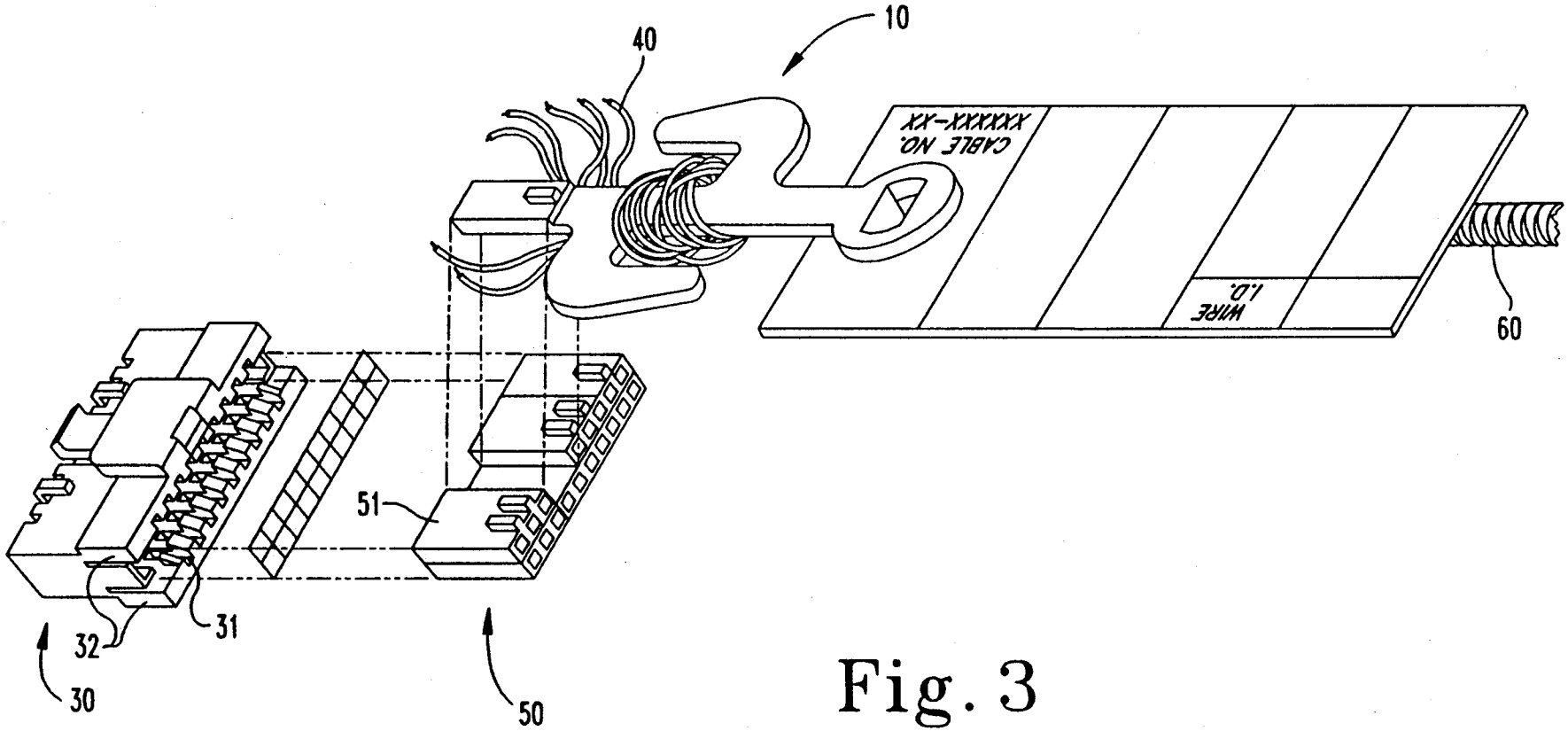
FIG. 3 is an exploded view of the modular plug-in strain relief connector shown in the prior figures incorporated with multiple plug-in electrical connectors and a housing assembly.
Figure 4:
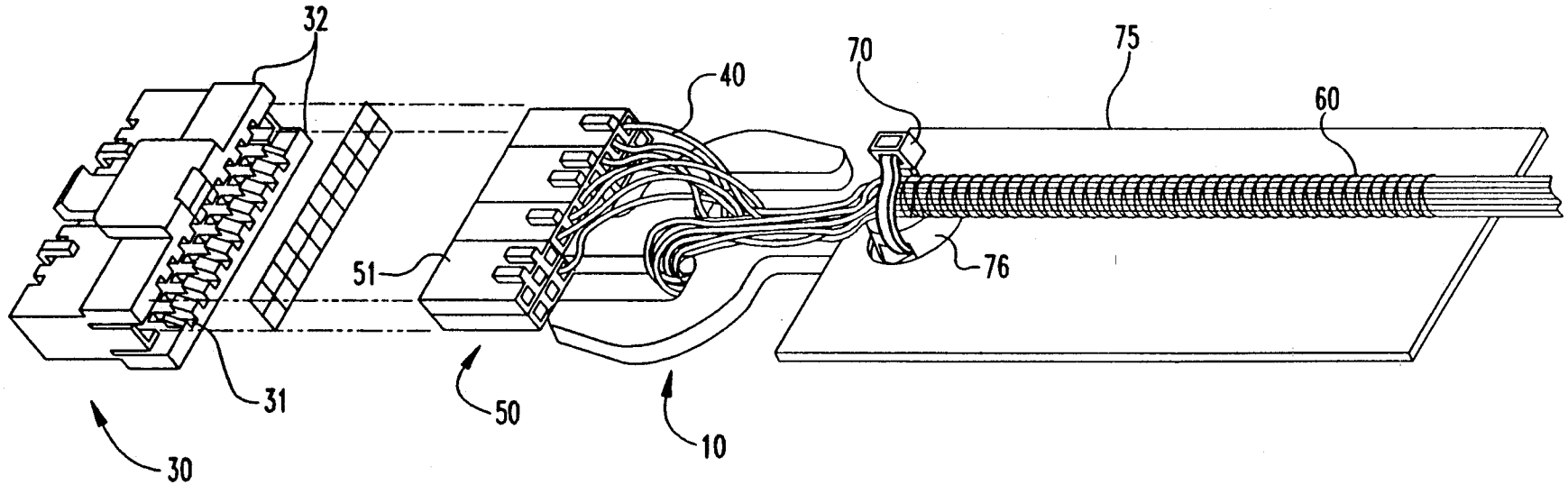
FIG. 4 is a partial exploded elevational view of the assembly shown in FIG. 3.

In one embodiment of the present invention, a strain relief device 10 is provided to aid in preserving electrical contact between wire conductors 40 and an electrical plug-in connector array 50 (FIG. 3). The connector array 50 can be of well known construction and is adapted to be located in a housing assembly 30 having multiple plug-in connector locations. FIGS. 3 and 4 show the removable strain relief device 10 providing strain relief for a bundle of conductors 60 which are attached to multiple plug-in connectors 51 forming the connector array 50, all of which are then locked into a housing assembly 30.

Figure 2:
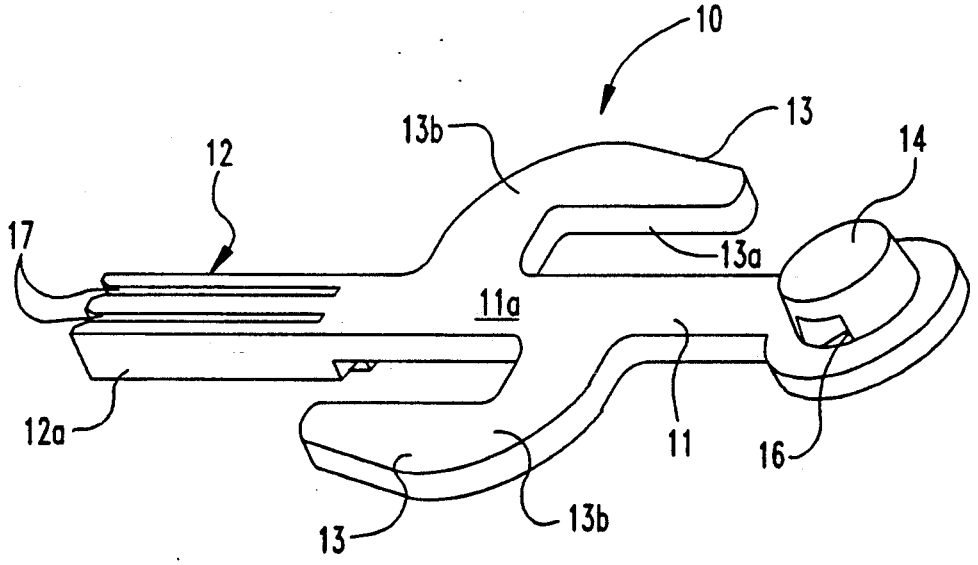
FIG. 2 is a bottom perspective view of the modular plug-in strain relief connector of FIG. 1.

The details of the strain relief device 10 are shown in FIGS. 1 and 2. Strain relief is provided by the flexible body 11 of the strain relief connector 10. The flexible body 11 has an outer surface 11*a* for supporting a portion of the wire conductors 40 wrapped around the body 11. The wrapped conductors 40 are enclosed by arm means or arm-like projections 13 when the wire conductors 40 are supported by the outer surface 11*a*.

Optimum strain relief is provided by wrapping the wire conductors 40 transversely across surface 11*a* and around body 11 as is shown in FIGS. 3 and 4.

The arm means 13 initially extend perpendicular from the body 11 and curve about 90 degrees to terminate in an orientation parallel to the body 11. This provides edge surfaces 13*a* for the purpose of enclosing a portion of the wire conductors 40 and causing them to remain in close proximity to the body 11. The end of a first arm means 13 points in a direction 180 degrees opposite to that of the second arm means on the opposite side of the body 11. The purpose of the arm means 13 extending opposite with respect to each other is to prevent the wire conductors from sliding along the body of the strain relief device 10. The bends 13*b* of the arm means define an area along the body 11*a* of the strain relief device within which the wire conductors 40 are forced to remain.

The removable strain relief device 10 has locking means 12 designed to lock directly into an unused connector location in the interior of the housing assembly 30 as shown in FIG. 3. The locking means 12 includes a body 12*a* shaped substantially like an individual plug-in electrical connector 51. The body 12*a* carries a locking tab 15 to engage the housing in a conventional manner, and a number of slots 17 for slidably receiving pins from a mating electrical connector to which the connector 50 is engaged. This enables the strain relief device 10 to emulate a plug-in electrical connector 51 for the purpose of locking into the housing assembly 30. The locking tab 15 also acts as a polarization feature to prevent upside-down assembly of the strain relief device 10 into the housing assembly 30.

In the assembled embodiment shown in FIGS. 3 and 4, at least one plug-in connector 51 is necessary to help lock device 10 into place in the interior of the housing assembly 30.

The strain relief device 10 enters the housing assembly 30 simultaneously with the plug-in electrical connectors as shown in FIGS. 3 and 4. As such, the device 10 occupies a plug-in connector location in the housing. The results in a reduced number of usable connector locations. In an alternate embodiment, the strain relief device can also be configured to engage an empty cavity in the housing, for example unused space between the connector array 50 and the inside wall of the housing 30, thereby permitting the full use of all of the plug-in connector locations defined for the housing assembly.

Figure 5:
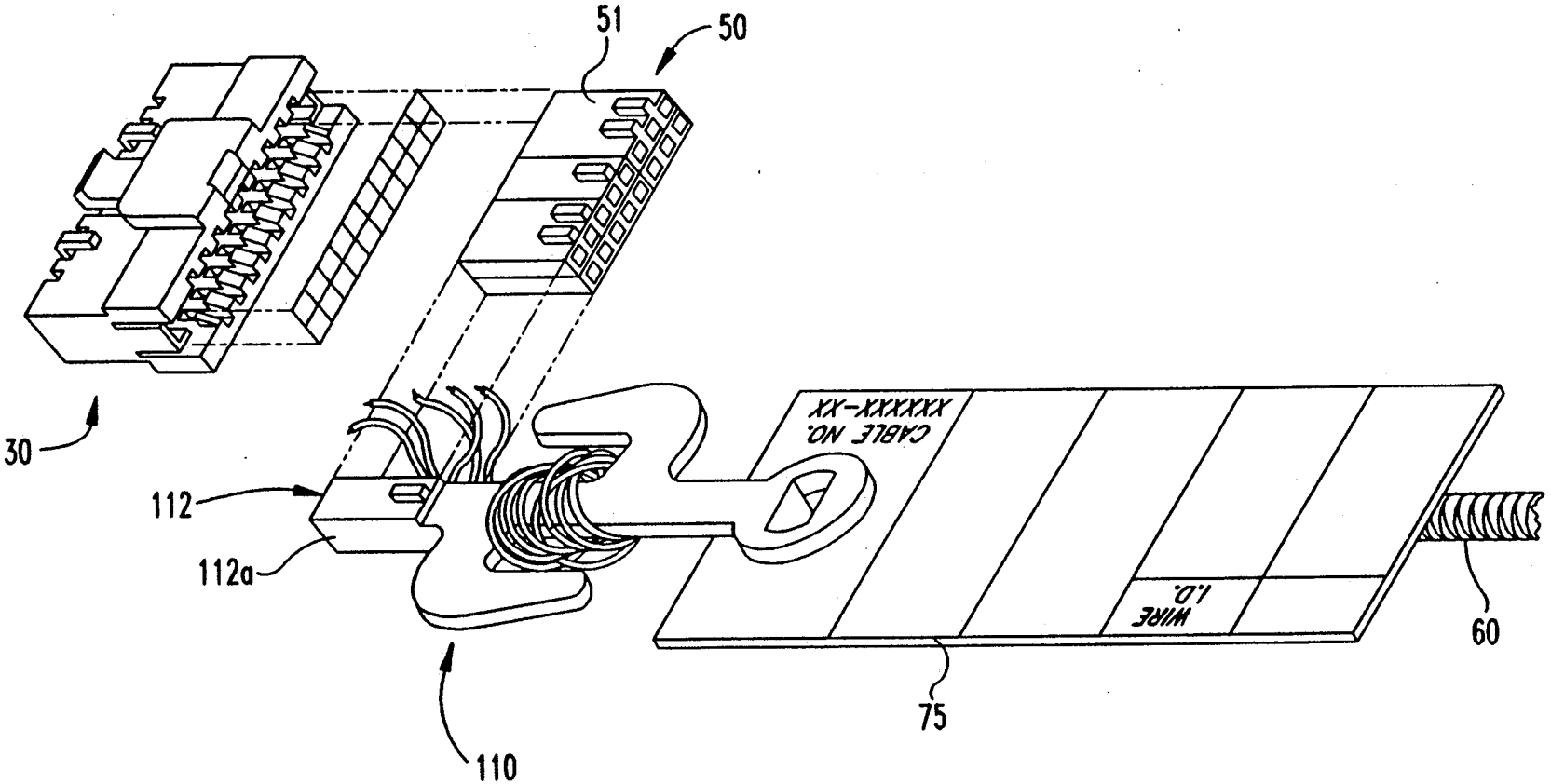
FIG. 5 is an exploded view of an alternate embodiment of the strain relief connector that occupies several, back-to-back connector locations.

In an alternate embodiment of the invention, a strain relief device includes locking means 112 comprising includes a body 112*a* configured to resemble two plug-in connectors, one laid on top of the other, as depicted in FIG. 5. Thus, the strain relief device 110 can be seated in the housing 30, independent of the presence of adjacent plug-in connectors 51.

Referring again to FIGS. 1–4, the number of slots 17 located in the locking means 12 ppreferably corresponds to the number of plug-in electrical connector locations that the strain relief device 10 occupies in the housing assembly 30. Alternatively, electrical connectors can be placed in the slots 17. These connectors can be attached to wire conductors 40. In this manner, the strain relief device 10 can also act as an electrical connector when it is necessary to use all available connector spaces.

The structure of the locking means 12 permits easy deliberate removal of the strain relief device 10 from the assembly housing 30 while providing for difficult accidental removal. The strain relief device 10 is inserted into the housing assembly by sliding the body of the locking means 12 into the housing 30. The locking tab 15 engages with a groove 31 standard to the housing assembly 30 to ensure proper orientation and to prevent movement of the device 10. Typically connector 51 also includes at least one tab for sliding into the standard grooves 31. The strain relief device 10 slides into the housing assembly 30 back-to-back with a plug-in electrical connector 51 until the locking means body 12*a* snaps into place between the flanges 32 at opposite edges of the housing 31 (see FIG. 4). The plug-in connector 51 locks into place in the same manner as the strain relief device 10. The presence of the plug-in electrical connector 51 back-to-back with the body of the locking means 12 creates a tight fit inside the housing assembly 30 keeping both the plug-in connector 51 and the strain relief device 10 from slipping out of the housing assembly 30. The strain relief device 10 can then be pulled from the housing assembly 30 while simultaneously forcing the flanges 32 of the housing assembly apart. Since the locking means 12 permits plug-in engagement with the housing assembly 30, the device can be used in a number of housing assemblies designed for the use of plug-in electrical connectors.

Additional strain relief is provided by securing a bundle of wire conductors 60 incident to the strain relief device 10 directly to the body 11. This is accomplished in one embodiment by securing the conductor bundle 60 to the device 10 using a cable tie 70 (FIG. 4). An example of a cable tie useful to this application is shown in U.S. Pat. No. 3,965,538 to Caveney, et. al. The cable tie 70 is threaded through aperture 16 of an integrally molded projection 14 located on the body 11 of the strain relief device 10 (FIG. 2) and is used to secure the bundle of conductors 60 to the strain relief connector 10 as shown in FIG. 4. As depicted in FIGS. 4 and 5, an identification tag 75 can be affixed to the strain relief device 10 using the projection 14 and insertion tie 70. The projection 14 can extend through a close-fitting opening 76 in the tag 75. Engagement of the tie 70 through the aperture 16 in the projection 14 holds the tag on the projection 14.

The body 11 is made of a flexible material, black nylon in the preferred embodiment, using conventional molding techniques, and can absorb strain applied to the bundle of conductors by bending vertically in the direction depicted by the arrows A in FIG. 1. In one specific embodiment, the body 11 is flexible enough to bend 90 degrees in each direction. The flexibility of the device 10, the method of securing the wire conductors 40 to the strain relief device 10 by wrapping them around the body 11 and the method of providing additional strain relief by securing the wire conductors to the body of the device 10 with a cable tie 70 secured through aperture 16 provide optimum protection for the electrical connection between the wire conductors 40 and the plug-in electrical connector 50.

Figure 6:
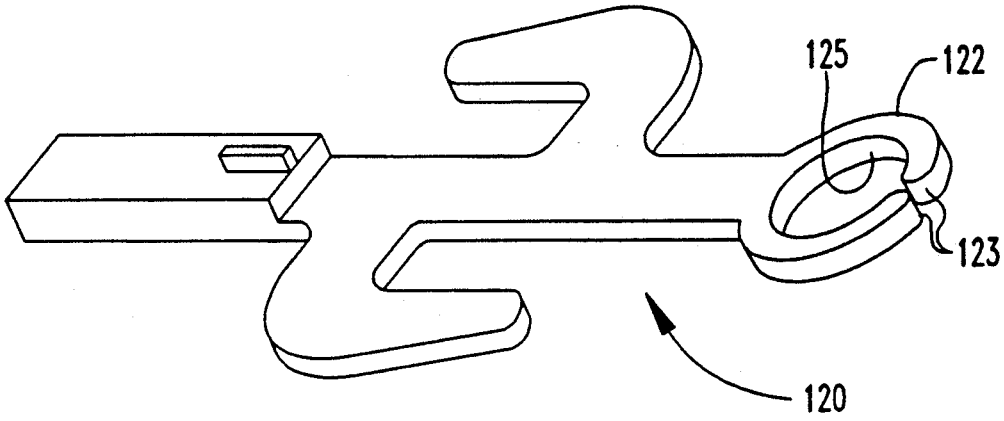
FIG. 6 is a top perspective view of a modular strain connector of an alternative embodiment of the invention.

In an alternative embodiment of the invention shown in FIG. 6, a strain relief device 120 is similar to the device 10 except that the projection 14 has been replaced by a self-closing integral eye 122. The ends 123 of the self-closing eye 122 are adapted to spread apart to permit insertion of a wire bundle into aperture 125. In this embodiment, the wire bundle is held against the device 120 without the need for a separate insertion tie.

Figure 7:
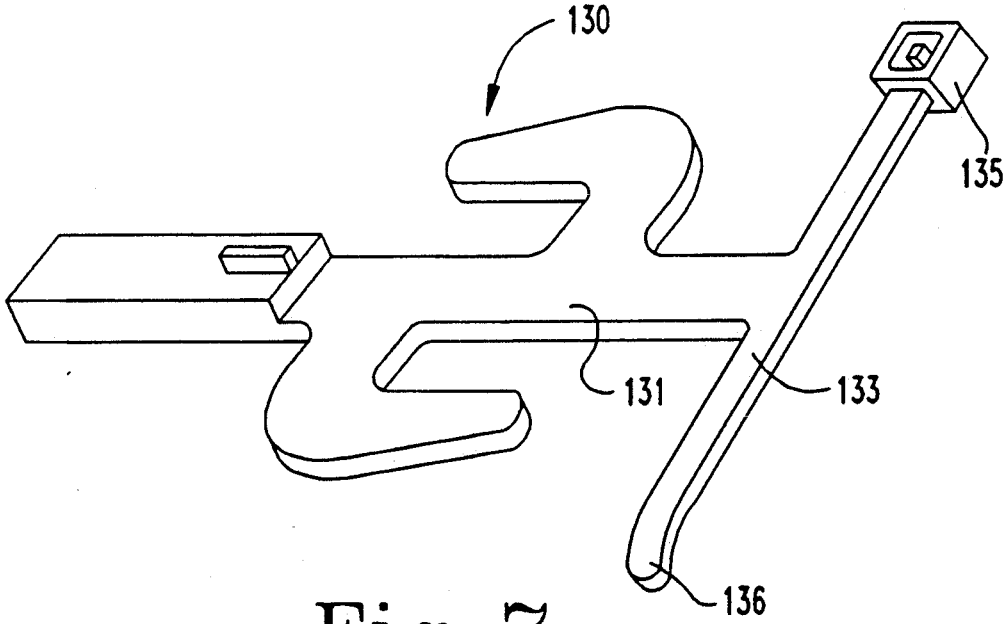
FIG. 7 is a top perspective view of a modular strain connector of an alternative embodiment of the invention.

Referring to FIG. 7, a further embodiment comprises a device 130 which is again similar to the prior devices.

In this embodiment, the cable tie feature is integral with the body 131. Thus, a strap member 133 is integrally formed at one end of the body 131. A locking member 135 is formed at one end of the strap member 133 and is adapted to receive the free end 136 of the strap in a manner substantially as described in the Caveney et al. U.S. Pat. No. 3,965,538.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A removable plug-in device for preserving the electrical contact between a wire conductor and a plug-in electrical connector for use in a connector housing assembly having multiple plug-in connector locations in its interior in which the plug-in electrical connectors are used for electrically contacting a mating electrical connector, said device comprising:

a body having an outer surface for supporting a portion of said wire conductors wrapped transversely about said body;

arm means for maintaining said wire conductors in close proximity around the outer surface of said body; and locking means carried by said body for removably locking said body into the interior of said housing assembly.

2. The device according to claim 1 wherein said body is formed of a flexible material.

3. The device according to claim 1 wherein said body, said arm means and said locking means are integrally formed.

4. The device according to claim 1 wherein said arm means includes a first arm and a second arm, each said arm initially extending perpendicularly from said body and curving about 90 degrees to terminate in a parallel orientation to said body, wherein said first arm points in a direction approximately 180 degrees opposite to that of said second arm.

5. The device according to claim 1 wherein said locking means is configured to occupy an unused connector location within said housing assembly.

6. The device according to claim 1 wherein said locking means is configured to occupy a plurality of unused connector locations within said housing assembly.

7. The device according to claim 1 wherein said locking means includes a number of slots for slidably receiving pins from a mating electrical connector.

8. The device according to claim 1 wherein said body includes a molded projection defining an aperture adapted to receive a cable tie therethrough, whereby a bundle of wire conductors can be secured to the body of the strain relief device by engagement of the cable tie around the bundle and through said aperture.

9. The device according to claim 5 wherein said locking means includes a body configured substantially similar to one of the plug-in electrical connectors and a locking tab for engaging the interior of the connector housing assembly.

10. A removable plug-in device for providing strain relief to a bundle of wire conductors and a plug-in electrical connector located in a housing assembly having multiple plug-in connector locations in which the plug-in electrical connectors are used for electrically contacting mating electrical connectors, said device comprising:

a body having an outer surface for supporting a portion of the bundle of wire conductors wrapped transversely about said body;

locking means for locking said removable plug-in device into an unused connector location internal to said housing assembly;

arm means located on either side of said body for maintaining the bundle of wire conductors in close proximity to said body; and means on said body for securing the bundle of wire conductors to said body.

11. The device according to claim 10 said locking means includes a number of slots for slidably receiving pins from a mating electrical connector.

12. The device according to claim 1 wherein said arm means includes a first arm and a second arm, each said arm initially extending perpendicularly from said body and curving about 90 degrees to terminate in a parallel orientation to said body, wherein said first arm points in a direction approximately 180 degrees opposite to that of said second arm.

13. The device according to claim 10 wherein said means for securing includes a projection integrally molded on said body and defining an aperture adapted to receive a cable tie therethrough, whereby the bundle of wire conductors can be secured to the body of the strain relief device by engagement of the cable tie around the bundle and through said aperture.

14. The device according to claim 10 wherein said means for securing includes a self-closing eye defining an aperture through which the bundle extends and opposing openable ends adapted to spread apart to permit insertion of the bundle into said aperture.

15. The device according to claim 10 wherein said means for securing includes a cable tie integrally formed on said body, said cable tie having an elongated strap member adapted to encircle the bundle of wire conductors with a locking member at one end of the strap member to receive the other end of the strap member in locking engagement.

* * * * *